US009593535B2

(12) United States Patent
Fears et al.

(10) Patent No.: US 9,593,535 B2
(45) Date of Patent: Mar. 14, 2017

(54) DRILL PIPE PERFORATOR APPARATUS AND METHOD OF USE

(71) Applicants: Brett Fears, Mustang, OK (US); Jason Burke, Thornton, CO (US); Roger Schultz, Ninnekah, OK (US)

(72) Inventors: Brett Fears, Mustang, OK (US); Jason Burke, Thornton, CO (US); Roger Schultz, Ninnekah, OK (US)

(73) Assignee: Thru Tubing Solutions, LLC, Oklahoma City, OK (US)

( * ) Notice: Subject to any disclaimer, the term of this patent is extended or adjusted under 35 U.S.C. 154(b) by 778 days.

(21) Appl. No.: 13/957,163

(22) Filed: Aug. 1, 2013

(65) Prior Publication Data

US 2014/0048333 A1 Feb. 20, 2014

Related U.S. Application Data

(60) Provisional application No. 61/683,748, filed on Aug. 16, 2012.

(51) Int. Cl.
*E21B 7/18* (2006.01)
*E21B 43/114* (2006.01)

(52) U.S. Cl.
CPC ..... *E21B 7/18* (2013.01); *E21B 43/114* (2013.01)

(58) Field of Classification Search
CPC ..... E21B 43/11; E21B 43/112; E21B 43/119; E21B 7/18; E21B 43/114; E21B 34/14
USPC ..... 166/295, 55, 177.5
See application file for complete search history.

(56) References Cited

U.S. PATENT DOCUMENTS

| | | | | |
|---|---|---|---|---|
| 7,681,635 | B2 * | 3/2010 | Farabee | E21B 43/114 166/177.5 |
| 7,703,510 | B2 * | 4/2010 | Xu | E21B 43/26 166/177.5 |
| 2010/0044041 | A1 * | 2/2010 | Smith | E21B 34/14 166/280.1 |
| 2011/0114319 | A1 | 5/2011 | Xu et al. | |
| 2011/0146989 | A1 * | 6/2011 | Dotson | E21B 43/114 166/298 |
| 2011/0253383 | A1 | 10/2011 | Porter et al. | |
| 2012/0012322 | A1 | 1/2012 | Korkmaz et al. | |
| 2012/0031615 | A1 * | 2/2012 | Connell | E21B 43/114 166/298 |
| 2012/0133367 | A1 * | 5/2012 | Bittar | E21B 43/26 324/346 |
| 2012/0186816 | A1 | 7/2012 | Dirksen et al. | |
| 2013/0213646 | A1 * | 8/2013 | Angman | E21B 47/09 166/255.1 |

OTHER PUBLICATIONS

Interational Search Report and Written Opinion; International Application No. PCT/US2013/053279; mailed Oct. 15, 2013; 10 pages.

* cited by examiner

*Primary Examiner* — Michael Wills, III
(74) *Attorney, Agent, or Firm* — Hall Estill Law Firm

(57) ABSTRACT

This disclosure is related to a perforator tool and a method of using the perforator tool to perforate a formation. The perforator tool can include a first and second sleeve and optionally a third sleeve. The perforator tool can also include at least one perforation opening and at least one circulation port. The sleeves are slidably disposed within the perforator tool and can be displaced to permit perforation of the formation, block the perforation openings and open circulation ports.

30 Claims, 5 Drawing Sheets

110
116
128
113
122
112
114
126
124
118
120

DRILL PIPE PERFORATOR APPARATUS AND METHOD OF USE

CROSS-REFERENCE TO RELATED APPLICATIONS

The present application is a conversion of U.S. Provisional Application having U.S. Ser. No. 61/683,748, filed Aug. 16, 2012, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The disclosure relates to an apparatus and method for perforating oil and/or gas formations.

2. Brief Description of Related Art

During production of oil and/or gas wells formations can be perforated to increase production of hydrocarbons from the well. Typical tools used in perforation applications do not permit the circulation of fluid once the tool has been used to perforate the formation. To this end, a method and apparatus for perforating the formation and circulating fluid after perforating the formation.

SUMMARY OF THE DISCLOSURE

The present disclosure is directed to method of perforating a formation. A perforator tool can be introduced into a wellbore. Fluid can then be flowed through the perforator tool to a hydraulically operable tool.

A portion of the fluid can the be blocked from flowing through the perforator tool and initiating perforation of the formation at a predetermined depth. Another portion of the fluid can be blocked to substantially stop perforation of the formation and permitting fluid to recirculate through the perforator tool to the hydraulically operable tool.

The present disclosure is also related to a perforator tool. The perforator tool can include an outer cylindrical housing having a first end, a second end, a throughway permitting fluid to flow through the perforator tool from the second end to the first end of the perforator tool, at least one perforation opening disposed in the outer cylindrical housing and at least one circulation port disposed in the outer cylindrical housing. The tool can also include a first sleeve having a first position within the perforator tool substantially blocking fluid flow to the at least one perforation opening and a second position within the perforator tool exposing the at least one perforation opening. The perforator tool further includes a second sleeve having a first position within the perforator tool substantially blocking fluid flow to the at least one circulation port and a second position within the perforator tool exposing the at least one circulation port.

Another embodiment of the perforator tool is provided in the present disclosure. In this embodiment, the perforator tool includes an outer cylindrical housing having a first end, a second end, a throughway permitting fluid to flow through the perforator tool from the second end to the first end of the perforator tool, and at least one perforation opening disposed in the outer cylindrical housing. The tool also includes a first sleeve disposed within the outer cylindrical housing having a first position and a second position within the outer cylindrical housing, the first sleeve having first portion, second portion, at least one perforation port to permit fluid to flow through the at least one perforation opening when the first sleeve is in the first position, and at least one circulation port to permit recirculation of fluid through the perforator tool when the first sleeve is in the second position. The perforator tool further includes a second sleeve disposed within the outer cylindrical housing and partially within the first sleeve, the second sleeve having a first position within the outer cylindrical housing substantially blocking fluid from the at least one perforation ports in the first sleeve and permitting fluid to flow through the throughway, the second sleeve having a second position wherein fluid is blocked from flowing through the perforator tool and forced out of the at least one perforation opening to perforate a formation.

The present disclosure is also directed toward a method of reducing fracturing breakdown pressure. The method includes drilling a portion of a wellbore into a formation with a perforator tool disposed on the work string. The method also includes perforating at least one location in the wellbore by abrasively perforating out into the formation to create at least one perforated zone without removing any tools from the wellbore. The method further includes fracturing the at least one perforated zone.

DETAILED DESCRIPTION OF THE DISCLOSURE

Figure 1:
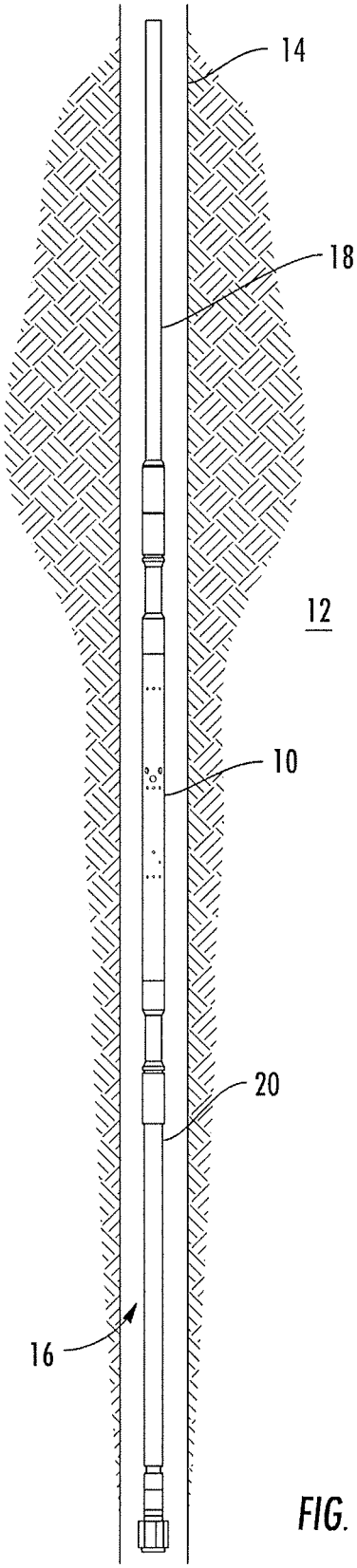
FIG. 1 is a side elevation view of a drill string including a perforator tool constructed in accordance with the disclosure.

The present disclosure relates to an apparatus 10 and method for perforating a formation 12. FIG. 1 shows the apparatus 10 disposed in a well bore 14 as part of a drill string 16. The drill string 16 can include drill pipe 18 and a bottom hole assembly (BHA) 20. The BHA 20 can include any components known in the art for inclusion into a BHA 20, such as a combination of a downhole motor, bit, MWD, LWD, any hydraulically operable tool, and the like. In one embodiment, the method of perforating the formation 12 can be accomplished without removing any components of the BHA 20. The present disclosure also relates to a method of reducing breakdown pressure of the formation 12 during fracturing operations. Additionally, the present disclosure is directed towards methods of positioning the apparatus 10 to orient the perforations is predetermined directions and determining desired perforation depths.

Figures 2, 3, 4, 5, 6:
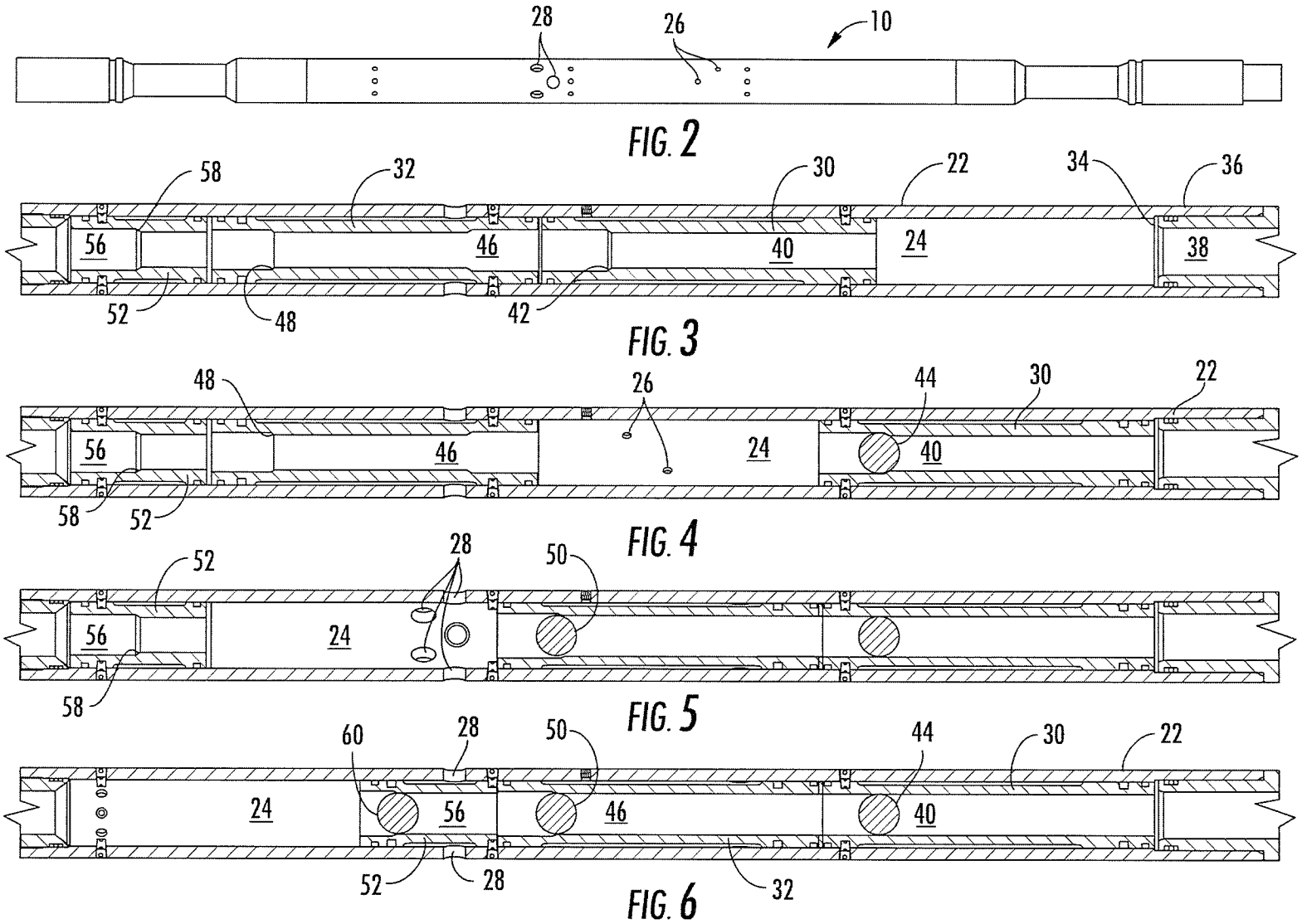
FIG. 2 is a side elevation view of the perforator tool constructed in accordance with the disclosure.
FIG. 3 is a cross-sectional view of one embodiment of the perforator tool constructed in accordance with the disclosure.
FIG. 4 is a cross-sectional view of another embodiment of the perforator tool constructed in accordance with the disclosure.
FIG. 5 is a cross-sectional view of another embodiment of the perforator tool constructed in accordance with the disclosure.
FIG. 6 is a cross-sectional view of another embodiment of the perforator tool constructed in accordance with the disclosure.
Figure 7:
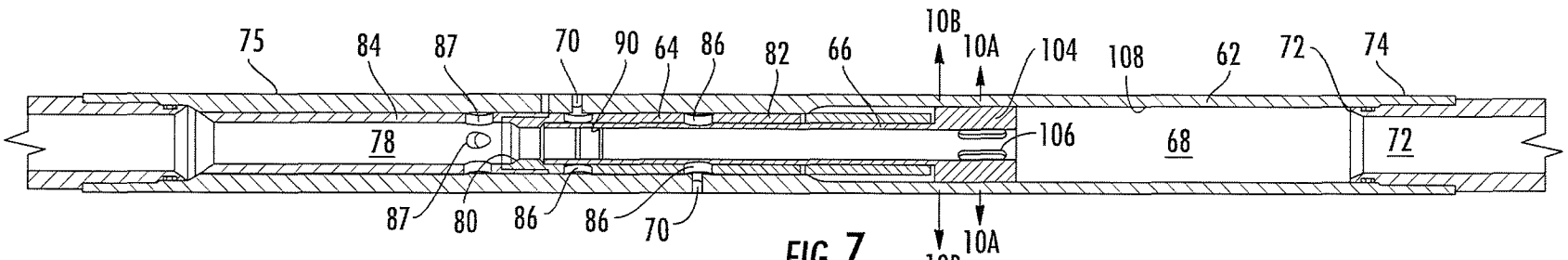
FIG. 7 is a cross-sectional view of another embodiment of the perforator tool constructed in accordance with the disclosure.
Figure 8:
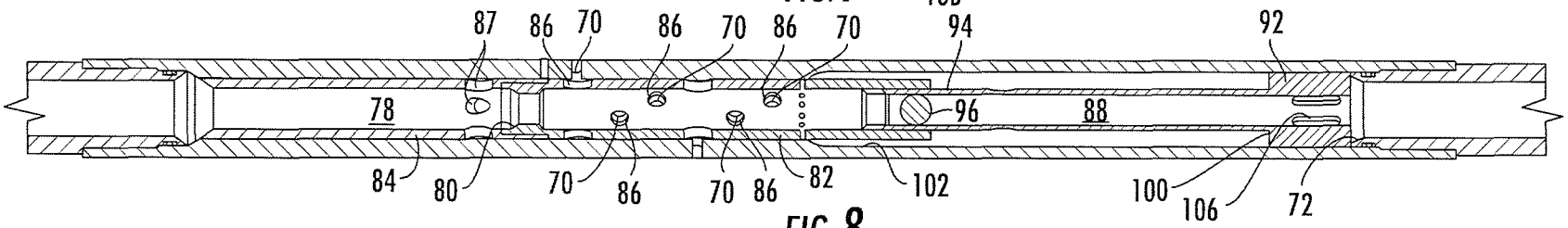
FIG. 8 is a cross-sectional view of another embodiment of the perforator tool constructed in accordance with the disclosure.
Figure 9:
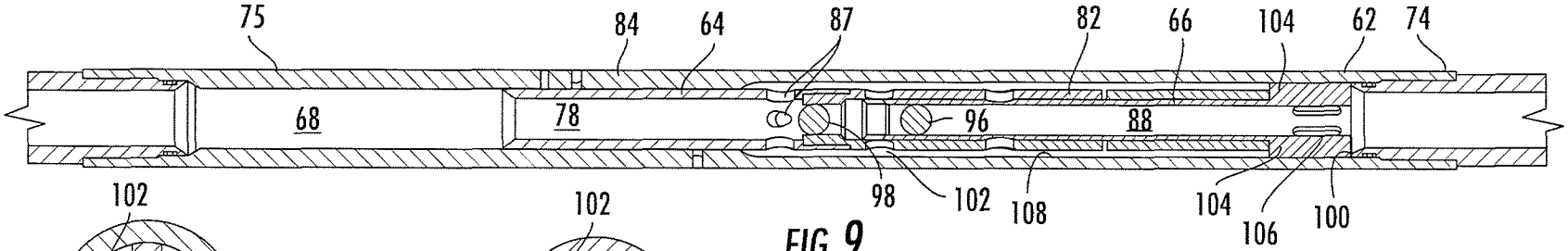
FIG. 9 is a cross-sectional view of another embodiment of the perforator tool constructed in accordance with the disclosure.
Figure 10B:
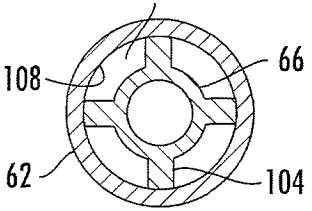
FIG. 10B is a cross-sectional view along the line B-B of FIG. 7 of one embodiment of the perforator tool constructed in accordance with the disclosure.
Figure 10A:
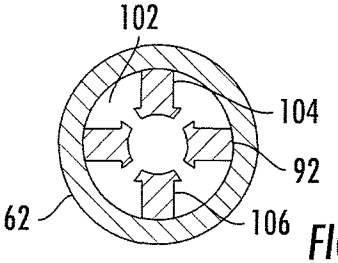
FIG. 10A is a cross-sectional view along the line A-A of FIG. 7 of one embodiment of the perforator tool constructed in accordance with the disclosure.
Figure 11:
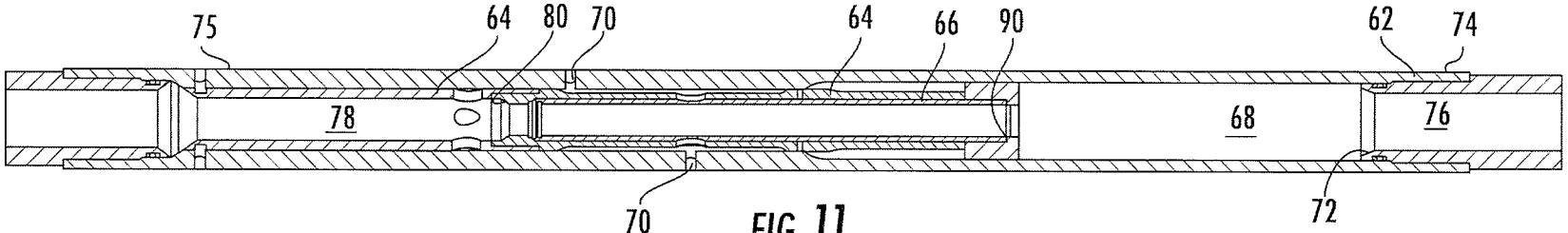
FIG. 11 is a cross-sectional view of another embodiment of the perforator tool constructed in accordance with the disclosure.
Figure 12:
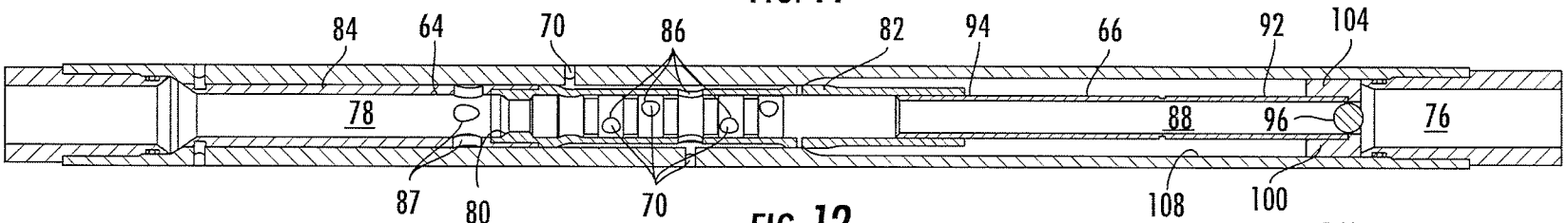
FIG. 12 is a cross-sectional view of another embodiment of the perforator tool constructed in accordance with the disclosure.
Figure 13:
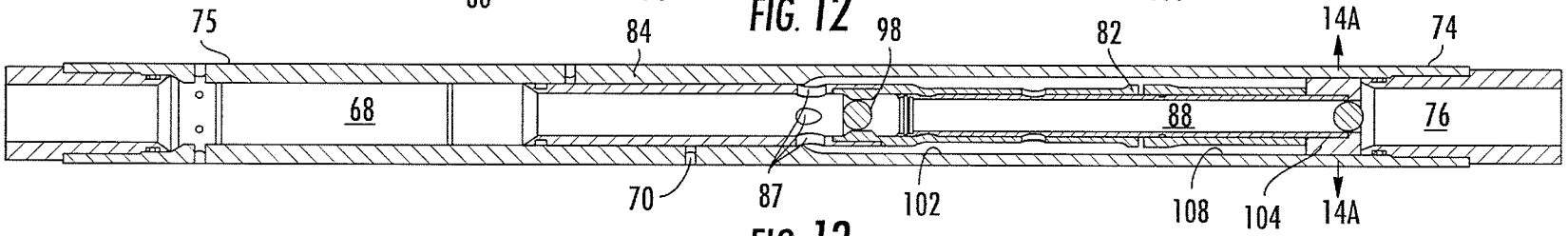
FIG. 13 is a cross-sectional view of another embodiment of the perforator tool constructed in accordance with the disclosure.
Figure 14B:
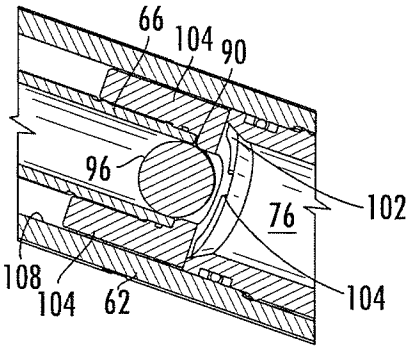
FIG. 14B is a perspective view of a cross-section of a portion of one embodiment of the perforator tool constructed in accordance with the disclosure.
Figure 14A:
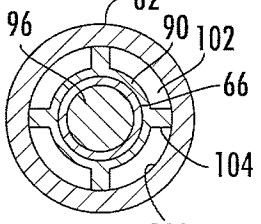
FIG. 14A is a cross-sectional view along the line A-A of FIG. 13 of one embodiment of the perforator tool constructed in accordance with the disclosure.
Figures 15, 16, 17, 18:
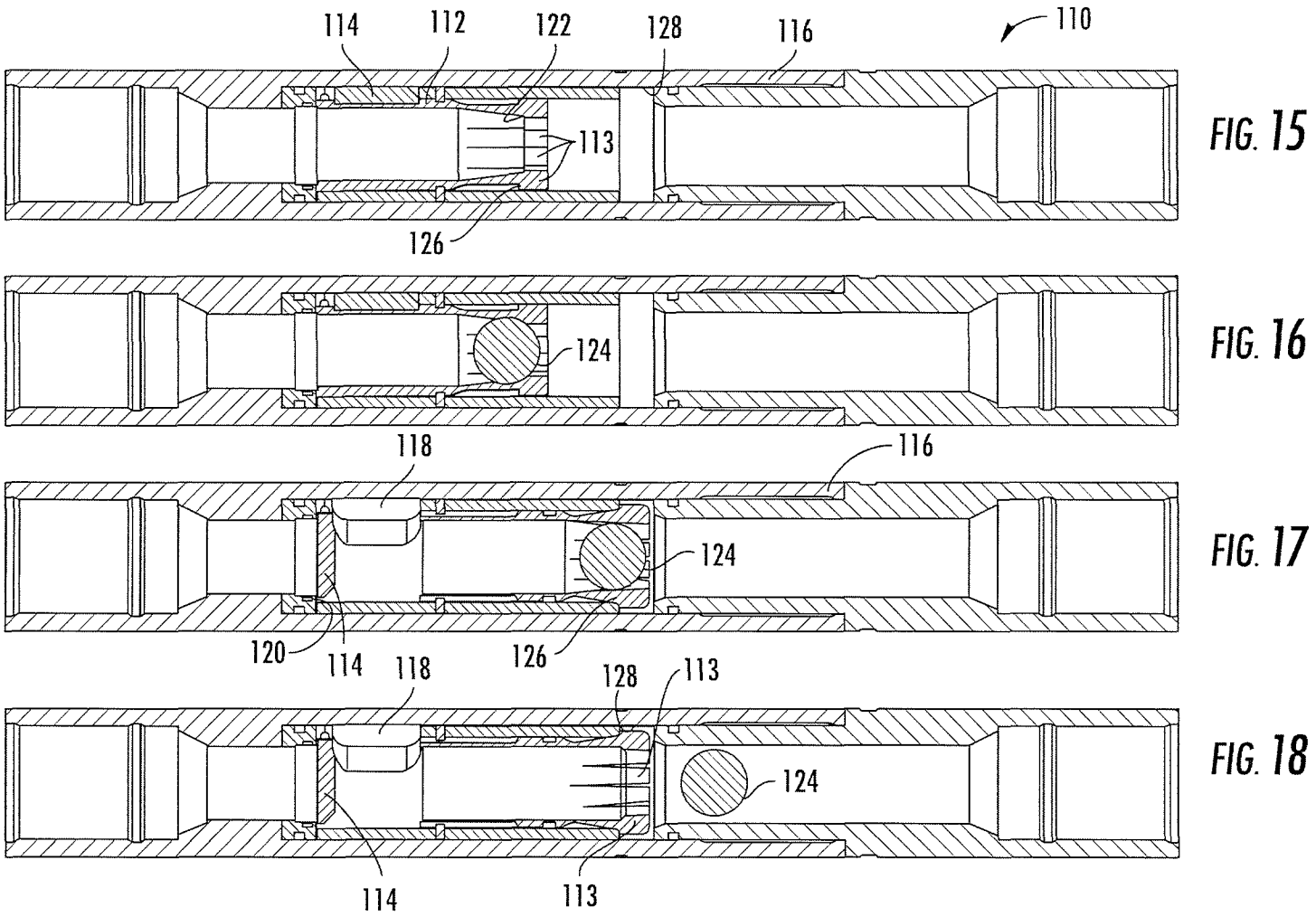
FIG. 15 is a cross-sectional view of a portion of one embodiment of a reverse flow control apparatus constructed in accordance with the disclosure.
FIG. 16 is a cross-sectional view of a portion of one embodiment of the reverse flow control apparatus constructed in accordance with the disclosure.
FIG. 17 is a cross-sectional view of a portion of one embodiment of the reverse flow control apparatus constructed in accordance with the disclosure.
FIG. 18 is a cross-sectional view of a portion of one embodiment of the reverse flow control apparatus constructed in accordance with the disclosure.

One embodiment of the apparatus 10 is shown in more detail in FIGS. 2 and 3. In this embodiment, the apparatus 10 includes an outer cylindrical housing 22, a throughway 24 running through the length of the outer cylindrical housing 22, at least one perforation openings 26 disposed in the outer cylindrical housing 22 and at least one circulation port 28 disposed in the outer cylindrical housing 22 of the apparatus 10. The apparatus 10 also includes a first sleeve 30 disposed inside the outer cylindrical housing 22 at a predisposed position to block fluid from flowing through the at least one perforation openings 26 in the outer cylindrical housing 22. Additionally, the apparatus 10 includes a second sleeve 32 disposed inside the outer cylindrical housing 22 at a predisposed position to block fluid from flowing through the at least one circulation port 28 in the outer cylindrical housing 22. The first and second sleeves 30 and 32 can be held in place inside the outer cylindrical housing 22 via any manner known in the art that can hold the sleeves 30 and 32 in place until a predetermined amount of force is placed on the sleeves 30 and 32. In one embodiment, the sleeves 30 and 32 are held in place with shear pins or screws.

The outer cylindrical housing 22 includes a sleeve seat 34 disposed in a first end 36 of the outer cylindrical housing 22. The sleeve seat 34 prevents the first sleeve 30 from exiting the perforator 10. The sleeve seat 34 also includes an opening 38 that extends through the sleeve seat 34 to permit fluid to pass through.

The first sleeve 30 has a passageway 40 therethrough and a lip (or seat) 42 that extends around an internal circumference of the first sleeve 30. The lip 42 can receive a first fluid blocking member 44 and prevent the first fluid blocking member 44 from passing past the lip 42. With enough pressure the first fluid blocking member 44 will engage the lip 42 and force the first sleeve 30 to slide inside the outer cylindrical housing 22 toward the first end 36 of the outer cylindrical housing 22 until the first sleeve 30 contacts the sleeve seat 34 (See FIG. 4). Once the first sleeve 30 has been displaced and positioned adjacent to the sleeve seat 34, the at least one perforation openings 26 in the outer cylindrical housing 22 is now in fluid communication with the throughway 24 disposed in the perforator 10. This permits fluid to be forced through the at least one perforation openings 26 in the outer cylindrical housing 22 and create perforations in the formation 12.

The second sleeve 32 has a passageway 46 therethrough and a second lip (or seat) 48 that extends around an internal circumference of the second sleeve 32. The second lip 48 can receive a second fluid blocking member 50 and prevent the second fluid blocking member 50 from passing past the second lip 48. With enough pressure, the second fluid blocking member 50 will engage the second lip 48 and force the second sleeve 32 to move inside the outer cylindrical housing 22 toward the first end 36 of the outer cylindrical housing 22 until the second sleeve 32 contacts the first sleeve 30, or is moved far enough within the apparatus 10 to unblock the at least one circulation port 28 and block the at least one perforation openings 26 (See FIG. 5). Once the second sleeve 32 has been displaced and positioned adjacent to the first sleeve 30, the at least one circulation port 28 in the outer cylindrical housing 22 is now in fluid communication with the throughway 24 disposed in the apparatus 10 and the fluid flow to the at least one perforation openings 26 has been blocked. This permits fluid to be forced through the at least one circulation port 28 in the outer cylindrical housing 22 and permit fluid to circulate through the apparatus 10 and back to the surface of the well bore 14.

In another embodiment of the present disclosure, the apparatus 10 can include a third sleeve 52 disposed inside a second end 54 of the outer cylindrical housing 22. The third sleeve 52 has a passageway 56 therethrough and a third lip (or seat) 58 that extends around an internal circumference of the third sleeve 52. The third lip 58 can receive a third fluid blocking member 60 and prevent the third fluid blocking member 60 from passing past the third lip 58. With enough pressure, the third fluid blocking member 60 will engage the third lip 48 and force the third sleeve 52 to move inside the outer cylindrical housing 22 toward the first end 36 of the outer cylindrical housing 22 until the third sleeve 52 contacts the second sleeve 32, or is moved far enough within the apparatus 10 to block the at least one circulation port 28 (See FIG. 6).

The fluid blocking members 44, 50 and 60 can be any device known in the art for sitting against the lips (or seats) 42, 48 and 58 and blocking fluid from passing. Examples include, but are not limited to, balls, darts, etc. In another embodiment, the fluid blocking members 44, 50 and 60 can be designed such that with enough fluid pressure the fluid blocking members 44, 50 and 60 can be pumped past the lips (or seats) 42, 48 and 58 and through the outer cylindrical housing 22. The fluid blocking members 44, 50 and 60 and/or the lips (or seats) 42, 48 and 58 may be deformable at a predetermined pressure. It should be understood and appreciated that the pressure at which the fluid blocking members 44, 50 and 60 and/or the lips (or seats) 42, 48 and 58 is a pressure that is higher than the pressure required to move the sleeves 30, 32 and 52 inside the outer cylindrical housing 22. In a further embodiment, the apparatus 10 can include a basket (not shown) to catch the fluid blocking members 44, 50 and 60 that have been forced through the apparatus 10.

It should be understood and appreciated that the fluid blocking members 44, 50 and 60 are sized differently. Additionally, the lips (or seats) 42, 48 and 58 are also sized differently from each other.

In yet another embodiment shown in FIGS. 7 thru 14, the perforator 10 includes an outer cylindrical housing 62, a first sleeve 64 slidably disposed within the outer cylindrical housing 62, a second sleeve 66 at least partially and slidably disposed within the first sleeve 64 of the perforator 10, a throughway 68 running through the length of the outer cylindrical housing 62 and at least one perforation opening 70 disposed in the outer cylindrical housing 62. The second sleeve 66 is disposed within the outer cylindrical housing 62 at a predetermined position such that the second sleeve 66 at least substantially prevents fluid flowing within the throughway 68 from exiting the perforator 10 via the at least one perforator opening 70. The outer cylindrical housing 62 further includes a first end 74 and a second end 75. The first end 74 has a larger inner diameter than the second end 75 of the outer cylindrical housing 62.

In a further embodiment, the outer cylindrical housing 62 includes a sleeve seat 72 disposed in the first end 74 of the outer cylindrical housing 62. The sleeve seat 72 prevents the second sleeve 66 from exiting the perforator 10. The sleeve seat 72 also includes an opening 76 that extends through the sleeve seat 72 to permit fluid to pass through.

The first sleeve 64 is in a first position within the outer cylindrical housing 62 and has a passageway 78 therethrough, a lip (or seat) 80 that extends around an internal circumference of the first sleeve 64, a first portion 82, and a second portion 84. The first portion 82 including at least one nozzle port 86 for allowing fluid to flow from the throughway 68 of the outer cylindrical housing 62 to the at least one perforation opening 70 of the outer cylindrical housing 62. The second portion 84 including at least one circulation port 87 for ultimately allowing fluid to flow from the passageway 78 of the first sleeve 64 to outside of the first sleeve 64.

The second sleeve 66 is positioned within the outer cylindrical housing 62 at a first position and includes a passageway 88 therethrough, a second lip (or seat) 90 that extends around an internal circumference of the second sleeve 66, a first end 92 and a second end 94. In one embodiment, the first end 92 of the second sleeve 66 has a larger outer diameter than the second end 94 of the second sleeve 66. The outer diameter of the second end 94 of the second sleeve 66 is sized such that it fits within the first sleeve 64 and the outer diameter of the first end 92 of the second sleeve 66 is sized such that it would fit within the inner diameter of the outer cylindrical housing 62 but not the inner diameter of the first sleeve 64.

The second lip 90 of the second sleeve 66 can receive a first fluid blocking member 96 and prevent the first fluid blocking member 96 from passing past the second lip 90. With enough pressure, the first fluid blocking member 96 will engage the second lip 90 and force the second sleeve 66 to slide inside the first sleeve 64 toward the first end 74 of the outer cylindrical housing 62 until the second sleeve 66 contacts the sleeve seat 72, a second position for the second sleeve 66 (See FIGS. 8 and 12). Once the second sleeve 66 has been displaced and positioned adjacent to the sleeve seat 72, the at least one perforation opening 70 in the outer cylindrical housing 62 is now in fluid communication with the throughway 68 disposed in the perforator 10 via the at least one nozzle port 86 of the first sleeve 64. This permits fluid to be forced through the at least one perforation opening 70 in the outer cylindrical housing 62 and create perforations in the formation 12. In one embodiment, the second end 94 of the second sleeve 66 is still disposed within the first portion 82 of the first sleeve 64.

Once the second sleeve 66 has been displaced within the outer cylindrical housing 62, the lip 80 of the first sleeve 64 can receive a second fluid blocking member 98 and prevent the second fluid blocking member 98 from passing past the lip 80. With enough pressure, the second fluid blocking member 98 will engage the lip 80 and force the first sleeve 64 to move inside the outer cylindrical housing 62 toward the first end 74 of the outer cylindrical housing 62 until the first sleeve 64 contacts a shoulder 100 of the first end 92 of the second sleeve 66 (a second position for the first sleeve 64), or is moved far enough within the perforator 10 to unblock the at least one circulation port 87 and block the at least one perforation openings 70 via the first portion 82 of the first sleeve 64 being now disposed about a portion of the second sleeve 66 (See FIGS. 9 and 13). Once the first sleeve 64 has been displaced and positioned back around a portion of the second sleeve 66, the at least one circulation port 87 in the outer cylindrical housing 62 is now in fluid communication with an annulus area 102 that is created between the outside diameter of the first sleeve 64 and the inner diameter of the second end 75 of the outer cylindrical housing 62 when the first and second sleeves 64 and 66 are in their second positions. Fluid flowing into the annulus area 102 can then flow out of the first end 74 (or bottom of the perforator 10) of the outer cylindrical housing 62. It should be understood that the second sleeve 66 disposed within a portion of the first sleeve 64 prevents fluid from the annulus area 102 from flowing through the nozzle ports 86 in the first sleeve 64 and readily blocks fluid from flowing through the perforator openings 70.

It should be understood and appreciated that the first and second lips 80 and 90 can be disposed at any location on the first and second sleeves 64 and 66, respectively. In one embodiment shown in FIGS. 7-9, the second lip 90 is disposed within the second end 94 of the second sleeve 66. In another embodiment shown in FIGS. 11-13, the second lip 90 is disposed within the first end 92 of the second sleeve 66.

In one embodiment shown in FIGS. 7-10, the first end 92 of the second sleeve 66 includes a plurality of fins 104 which extend therefrom and at least one opening 106. The plurality of fins 104 and the at least one opening 106 cooperate to permit fluid to flow from the annulus area 102 back into the passageway 88 of the second sleeve 66. The fluid can then flow out the first end 74 of the outer cylindrical housing 62.

In another embodiment shown in FIGS. 11-14, the first end 92 of the second sleeve 66 includes the plurality of fins 104 which cooperate with an inside portion 108 of the outer cylindrical housing 62 to create an area for the fluid to flow into from the annulus area 102. The area created by the cooperation of the fins 104 and the inside portion 108 of the outer cylindrical housing 62 is in fluid communication with the throughway 68 in the first end 74 of the outer cylindrical housing 62.

The first and second sleeves 64 and 66 can be held in place inside the outer cylindrical housing 62 via any manner known in the art that can hold the sleeves 64 and 66 in place until a predetermined amount of force is placed on the sleeves 64 and 66. In one embodiment, the sleeves 64 and 66 are held in place with shear pins or screws.

In another embodiment of the present disclosure shown in FIGS. 15-18, the perforator tool 10 can also include a reverse flow control apparatus 110 for preventing the flow of fluid back out of the perforator tool 10 and into the drill string. The reverse flow control apparatus 110 can be any apparatus or device that allows fluid and fluid blocking members 44, 50, 96 and 98 to pass through yet prevents fluid from flowing back up and out of the perforator tool 10. In one embodiment, the reverse flow control apparatus 110 includes a collet sleeve 112 having a plurality of finger elements 113 and a flapper element 114 disposed within a cylindrical housing 116.

In another embodiment, the flapper element 114 can be hingedly attached to the inside of the cylindrical housing 116 and disposed in a depression area 118. The collet sleeve 112 has a first position within the cylindrical housing 116 wherein the flapper element 114 is prevented from closing on a lip 120 disposed about the inner circumference in the cylindrical housing 116. In the first position, the collet sleeve 112 has a lip 122 on an inside circumference to receive a fluid blocking member 124. It should be understood that the lip 122 is created by having a portion of the lip 122 disposed on each finger element 113 of the collet sleeve 112.

In operation, the fluid blocking member 124 can contact the lip 122 and increased pressure of fluid behind the fluid blocking member 124 can cause the collet sleeve 112 to slide within the cylindrical housing 116 because the lip 122 prevents the fluid blocking member 124 from passing. Once the collet sleeve 112 has slid a predetermined distance in the cylindrical housing 116, the flapper element 114 will be permitted to engage the lip 120 and prevent fluid from going back out of the perforator tool 10 or back into the drill string 16. The finger elements 113 also include an outer lip 126 that can de disposed in a depression ring 128 disposed in the cylindrical housing 116. Once the outer lips 126 of the finger elements 113 reach the depression ring 128, the finger elements 126 will expand allowing the fluid blocking member 124 to pass through and ultimately enter the perforator tool 10 as described herein. It should be understood that the fluid blocking member 124 can be either the first fluid blocking members 44 or 96 as described herein.

In another embodiment, the perforator tool 10 can include more than one reverse flow control apparatus 110. In a further embodiment, the reverse flow control apparatus 110 can be set up wherein in initiation of the reverse flow control apparatus 110 is not required. In this embodiment, the perforator tool will not include the collet sleeve 112 and the flapper element 114 will be permitted to engage the lip 120 and prevent fluid from going back out of the perforator tool 10 or back into the drill string 16.

The present disclosure is also directed toward a method of using the perforator tool 10. In one embodiment, the perforator tool 10 and drilling BHA 20 can be run down into the wellbore 14. The wellbore 14 can be extended by the BHA 20. Once the perforator tool 10 has been drilled down to a desired location (or depth), the perforation of the formation 12 can be initiated by substantially blocking the flow of fluid through the perforator tool 10. Fluid can then be pumped through the perforation openings 26, 70 to create perforation tunnels in the formation 12. After perforation of the formation is completed, the perforation openings 26, 70 are closed and the circulation ports 28, 87 are opened to allow fluid to circulate through the perforator tool 10 and/or back to the BHA 20. The perforator tool 10 and BHA 20 can then be removed from the wellbore 14. It should be understood that the formation 12 can be drilled out using the BHA 20 and perforated without having to remove the BHA 20 from the wellbore 14. Being able to perforate and fracture the formation 12 without having to remove the BHA 20 from the wellbore 14 allows for better pressure penetration through mudcake and damaged radius around the wellbore 14 and reduces formation strength at perforation sites because material in hydraulic cross-sections have been removed.

In another embodiment of the present disclosure, a method of orienting the perforation openings 26, 70 is provided. In one embodiment, the location (e.g., distance, angular orientation, etc.) of the perforation openings 26, 70 of the perforator tool 10 relative to the MWD tools of the BHA 20 are determined or set. This allows the angular orientation of the perforator tool 10, and thus the perforation openings 26, 70, to be determined from the rotational orientation information from the MWD tools/equipment and/or LWD tools/equipment. Similar to other methods disclosed herein, the perforator tool 10 can be run down into the wellbore 14 to the desired depth. In a further embodiment, MWD orientation and/or angle readings can be observed and the angular position of the perforator tool 10 (and thus the perforation openings 26, 70) can be adjusted until the perforator tool 10 has the desired orientation for perforating.

In another embodiment, the desired orientation (angular position) of the perforator tool 10 can be determined by formation properties measured by LWD equipment present in the BHA 20. It should be understood and appreciated that the angular position of the perforator tool 10 can be adjusted by any method known in the art. For example, the angular position can be adjusted by rotating the drill pipe at the surface. The desired orientation of the perforator tool 10 can be done multiple times at different depths in the formation 12.

In yet another embodiment of the present disclosure, longitudinal offset information between the MWD equipment and/or the LWD equipment and the perforator tool 10 (or more specifically the perforation openings 26, 70) can be determined. This longitudinal offset information can be used by the MWD equipment and/or the LWD equipment to more precisely determine the depth of the perforator tool 10 and position the perforator tool 10 at a desired depth in the wellbore 14. Similar to other methods disclosed herein, the perforator tool 10 can use the longitudinal offset information and perforate multiple locations within the formation 12.

In another embodiment, the perforator tool 10 can be moved to a second desired location (or second depth) and fluid can be pumped through the perforation openings 26, 70 to create a second set of perforation tunnels in the formation 12. This can be repeated for as many desired locations (or depths) applicable for the perforation job being performed. Similar to that already disclosed herein, the BHA 20 does not have to be removed from the wellbore 14 to perforate the second desired location.

In another embodiment, the circulation ports 28, 87 can be closed and an inner portion of the perforator tool, which fluid now cannot flow through, can be drilled out which would allow fluid to be circulated through and reach the BHA 20. In another embodiment, the fluid blocking members 44, 50, 96, 98 and 124 can be forced through the perforator tool 10 by increasing the fluid pressure on the perforator tool 10.

In yet another embodiment, the reverse flow control apparatus 110 is initiated at substantially the same time as the fluid is blocked from flowing through the perforator tool 10 and before fluid is pumped down into the perforator tool 10 and out of the perforation openings 26, 70. In a further embodiment, the perforator tool 10 includes more than one reverse flow control apparatus 110 that is initiated at substantially the same time as the fluid is blocked from flowing through the perforator tool 10 and directed out of the perforation openings 26, 70.

From the above description, it is clear that the present invention is well adapted to carry out the objectives and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A method of perforating a formation, comprising the steps of:

introducing a perforator tool into a wellbore;

flowing fluid through the perforator tool to a hydraulically operable tool;

blocking at least a portion of the fluid from flowing through the perforator tool and initiating perforation of the formation at a predetermined depth;

blocking at least a portion of the fluid to substantially stop perforation of the formation and permitting fluid to recirculate through the perforator tool to the hydraulically operable tool; and blocking the recirculation of the fluid through the perforator tool.

2. The method of claim 1 further comprising repositioning the perforator tool at a second predetermined depth and perforating the formation at the second predetermined depth prior to the step of substantially stopping the perforation of the formation and permitting fluid to again flow through the perforator tool.

3. The method of claim 1 wherein the hydraulically operable tool is a drilling bottom hole assembly and is used to extend the wellbore.

4. The method of claim 1 further comprising flowing high pressure fluid through the perforator tool to force any fluid obstructions through the perforator tool to restore circulation of fluid through the perforator tool.

5. The method of claim 1 further comprising initiating a reverse flow control apparatus at substantially the same time that fluid is blocked from flowing through the perforator tool and the perforation of the formation is initiated.

6. The method of claim 5 wherein at least one other reverse flow control apparatus is also initiated at substantially the same time that fluid is blocked from flowing through the perforator tool and the perforation of the formation is initiated.

7. The method of claim 1 wherein the perforator tool includes at least one reverse flow control apparatus that does not require initiation for fluid to be prevented from flowing back up out of the perforator tool.

8. A perforator tool, the tool comprising:

an outer cylindrical housing having a first end, a second end, a throughway permitting fluid to flow through the perforator tool from the second end to the first end of the perforator tool, at least one perforation opening disposed in the outer cylindrical housing and at least one circulation port radially disposed in the outer cylindrical housing;

a first sleeve having a first position within the perforator tool substantially blocking fluid flow to the at least one perforation opening and a second position within the perforator tool exposing the at least one perforation opening; and a second sleeve having a first position within the perforator tool substantially blocking fluid flow to the at least one circulation port and a second position within the perforator tool exposing the at least one circulation port.

9. The perforator tool of claim 8 wherein the first sleeve includes a lip for receiving a first fluid blocking member to substantially block fluid flow through the perforator tool and force the first sleeve from the first position to the second position.

10. The perforator tool of claim 8 wherein the second sleeve includes a lip for receiving a second fluid blocking member to substantially block fluid flow to the at least one perforation opening and force the second sleeve from the first position to the second position.

11. The perforator tool of claim 8 wherein the perforator tool further comprises a third sleeve disposed within the outer cylindrical housing, the third sleeve having a first position and a second position within the outer cylindrical housing substantially blocking the at least one circulation port.

12. The perforator tool of claim 11 wherein the third sleeve includes a lip for receiving a third fluid blocking member to substantially block fluid flow through the at least one circulation port and force the third sleeve from the first position to the second position.

13. The perforator tool of claim 8 wherein the first end of the perforator tool further includes a sleeve seat to stop the first sleeve in its second position.

14. The perforator tool of claim 8 further comprising a reverse flow control apparatus for preventing the flow of fluid back out of the perforator tool.

15. The perforator tool of claim 14 wherein the reverse flow control apparatus includes a cylindrical housing, a collet sleeve and a flapper element hingedly attached within the cylindrical housing, the collet sleeve has a first position within the cylindrical housing that prevents the flapper element from closing on a lip in the cylindrical housing and a second position what permits the flapper element to close on the lip and prevent fluid from flowing back out of the perforator tool and permits fluid blocking member to freely flow through the reverse flow control apparatus.

16. The perforator tool of claim 15 wherein the flapper of the reverse flow control apparatus opens and permits fluid blocking members to flow through the reverse flow control apparatus.

17. The perforator tool of claim 8 wherein the perforator tool includes at least one reverse flow control apparatus that does not require initiation and at least one reverse flow control apparatus that is initiated by a fluid blocking member.

18. A perforator tool, the tool comprising:

an outer cylindrical housing having a first end, a second end, a throughway permitting fluid to flow through the perforator tool from the second end to the first end of the perforator tool, and at least one perforation opening disposed in the outer cylindrical housing;

a first sleeve disposed within the outer cylindrical housing having a first position and a second position within the outer cylindrical housing, the first sleeve having a first portion, a second portion, at least one perforation port to permit fluid to flow through the at least one perforation opening when the first sleeve is in the first position, and at least one circulation port to permit recirculation of fluid through the perforator tool when the first sleeve is in the second position; and a second sleeve disposed within the outer cylindrical housing and partially within the first sleeve, the second sleeve having a first position within the outer cylindrical housing substantially blocking fluid from the at least one perforation ports in the first sleeve and permitting fluid to flow through the throughway, the second sleeve having a second position wherein fluid is blocked from flowing through the perforator tool and forced out of the at least one perforation opening to perforate a formation.

19. The perforator tool of claim 18 further comprising an annulus area between the first sleeve and the outer cylindrical housing when the first sleeve and the second sleeve are in the second positions, the annulus area in fluid communication with the at least one circulation port and the first end of the outer cylindrical housing.

20. The perforator tool of claim 18 wherein the second sleeve includes a lip for receiving a first fluid blocking member to substantially block fluid flow through the perforator tool and force the second sleeve from the first position to the second position.

21. The perforator tool of claim 20 wherein the first sleeve includes a lip for receiving a second fluid blocking member to substantially block fluid flow to the at least one perforation opening and force the first sleeve from the first position to the second position.

22. The perforator tool of claim 21 wherein the lip of the first sleeve is disposed in a second end of the first sleeve.

23. The perforator tool of claim 20 wherein the lip of the second sleeve is disposed in a first end of the second sleeve.

24. The perforator tool of claim 18 wherein the at least one perforation port is disposed in the first end of the first sleeve and the at least one circulation port is disposed in the second end of the first sleeve.

25. A method of reducing fracturing breakdown pressure during fracturing operations, the method comprising:

drilling a portion of a wellbore into a formation with a perforator tool disposed on the work string, the work string including MWD equipment or LWD equipment, the perforator tool and perforation openings of the perforator tool having an angular offset and a longitudinal offset from the MWD equipment or the LWD equipment;

setting or determining the angular offset of the perforation openings relative to the MWD equipment or the LWD equipment;

perforating at least one location in the wellbore by abrasively perforating out into the formation to create at least one perforated zone without removing any tools from the wellbore; and fracturing the at least one perforated zone.

26. The method of claim 25 further comprising setting or determining the longitudinal offset of the perforator openings relative to the MWD equipment or the LWD equipment.

27. The method of claim 26 further comprising observing well bore depth data from the MWD equipment or LWD equipment and adjusting the depth of the perforation openings responsive to the depth and longitudinal offset of the MWD equipment or LWD equipment.

28. The method of claim 25 further comprising adjusting angular orientation of the perforation openings to desired angular orientation.

29. The method of claim 28 further comprising observing angular orientation of the MWD equipment or LWD equipment and adjusting the angular orientation of the perforation openings responsive to the angular orientation of the MWD equipment or LWD equipment.

30. The method of claim 28 further comprising observing formation properties via the LWD equipment and adjusting the angular orientation of the perforation openings responsive to the formation properties.

* * * * *